US011287215B1

(12) United States Patent
Carisch

(10) Patent No.: US 11,287,215 B1
(45) Date of Patent: Mar. 29, 2022

(54) WEARABLE GUN REST ASSEMBLY

(71) Applicant: Michael Carisch, Manhattan, MT (US)

(72) Inventor: Michael Carisch, Manhattan, MT (US)

( * ) Notice: Subject to any disclaimer, the term of this patent is extended or adjusted under 35 U.S.C. 154(b) by 1 day.

(21) Appl. No.: 17/100,420

(22) Filed: Nov. 20, 2020

(51) Int. Cl.
*F41C 33/00* (2006.01)
*A45F 3/14* (2006.01)
*A45F 3/00* (2006.01)

(52) U.S. Cl.
CPC ..... *F41C 33/007* (2013.01); *A45F 3/14* (2013.01); *A45F 2003/007* (2013.01)

(58) Field of Classification Search
CPC ..... A45F 3/14; A45F 2003/002; A45F 2003/007; F41C 33/007; F41C 33/006; F41C 33/003; F41C 33/005; F41C 33/001
USPC ..... 224/623
See application file for complete search history.

(56) References Cited

U.S. PATENT DOCUMENTS 695,176 A * 3/1902 Rumsey ..... F41C 33/007 224/604
1,561,564 A 11/1925 Nizamis
2,171,676 A * 9/1939 Wallace ..... A01K 97/06 2/48
D311,813 S 11/1990 Oliver
5,284,280 A 2/1994 Stonebraker
5,492,255 A 2/1996 Gansky
5,862,967 A 1/1999 Johnson
6,336,576 B1 * 1/2002 Easter ..... A45F 3/04 224/153
6,763,987 B1 7/2004 Eberle
7,013,596 B1 * 3/2006 Moore ..... A01K 97/06 224/920
8,960,511 B2 * 2/2015 Shepherd ..... A45C 3/00 224/259
D763,567 S 8/2016 Robert
9,797,679 B2 * 10/2017 Ponder ..... F41C 33/001
10,470,552 B2 11/2019 Ripepi
2002/0179656 A1 * 12/2002 Price ..... F42B 39/02 224/196
2013/0146628 A1 * 6/2013 Gump ..... F41C 33/0236 224/257

FOREIGN PATENT DOCUMENTS

DE 102012017793 3/2014

* cited by examiner

*Primary Examiner* — Corey N Skurdal

(57) ABSTRACT

A wearable gun rest assembly for supporting a firearm while a user is walking includes a panel that is hollow and the panel has a slot that extends into an interior of the panel. A neck strap is releasably attachable to the panel and the neck strap is wearable around the user's neck thereby facilitating the panel to be supported on the user's chest. A waist strap is releasably attachable to the panel and the waist strap is wearable around the user's waist thereby facilitating the panel to be retained against the user's chest. A gun support is removably integratable into the panel and the gun support has a gun slot is integrated therein to insertably receive a firearm for supporting the firearm in a horizontal orientation.

16 Claims, 8 Drawing Sheets

WEARABLE GUN REST ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to gun rest devices and more particularly pertains to a new gun rest device for supporting a firearm while a user is walking. The gun rest device rests on the user's chest while the user is walking to facilitate the firearm to be carried in a natural position. Additionally, the gun rest device has a plurality of ammunition storage pouches to facilitate ammunition for the firearm to be easily accessible.

(2) Description of Related Art Including Information Disclosed Under 37 CFR 1.97 and 1.98

The prior art relates to gun rest devices including a variety of backpacks that have a variety of gun rests integrated therein thereby facilitating the gun rest to support a firearm when the backpack is not being worn. The prior art also discloses a portable shooting table that can be worn as a backpack. In no instance does the prior art disclose a gun support that is wearable on a user's chest for supporting a firearm while a user is walking.

BRIEF SUMMARY OF THE INVENTION

An embodiment of the disclosure meets the needs presented above by generally comprising a panel that is hollow and the panel has A slot extends into an interior of the panel. A neck strap is releasably attachable to the panel and the neck strap is wearable around the user's neck thereby facilitating the panel to be supported on the user's chest. A waist strap is releasably attachable to the panel and the waist strap is wearable around the user's waist thereby facilitating the panel to be retained against the user's chest. A gun support is removably integratable into the panel and the gun support has a gun slot is integrated therein to insertably receive a firearm for supporting the firearm in a horizontal orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
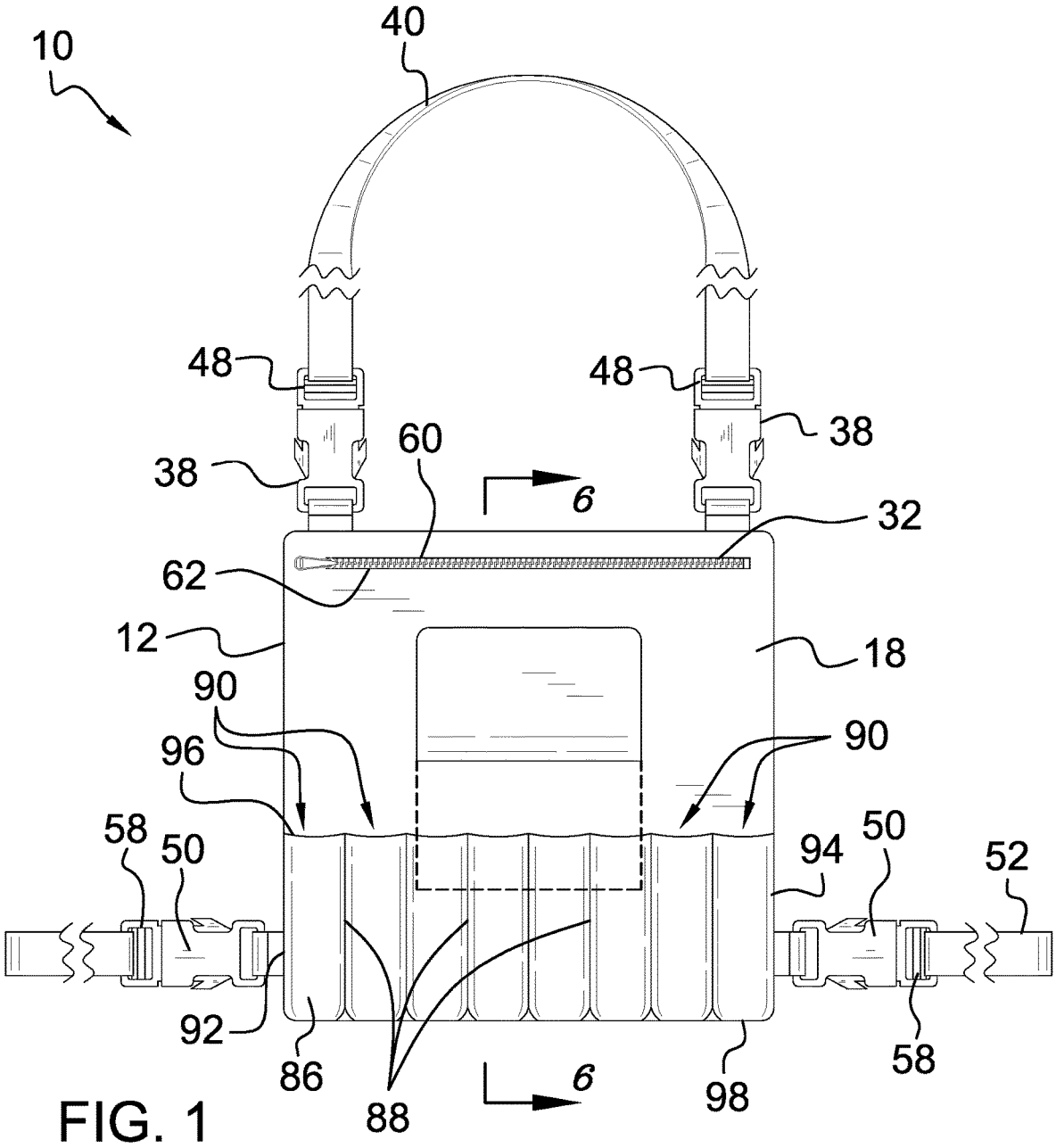
FIG. 1 is a front view of a wearable gun rest assembly according to an embodiment of the disclosure.
Figure 2:
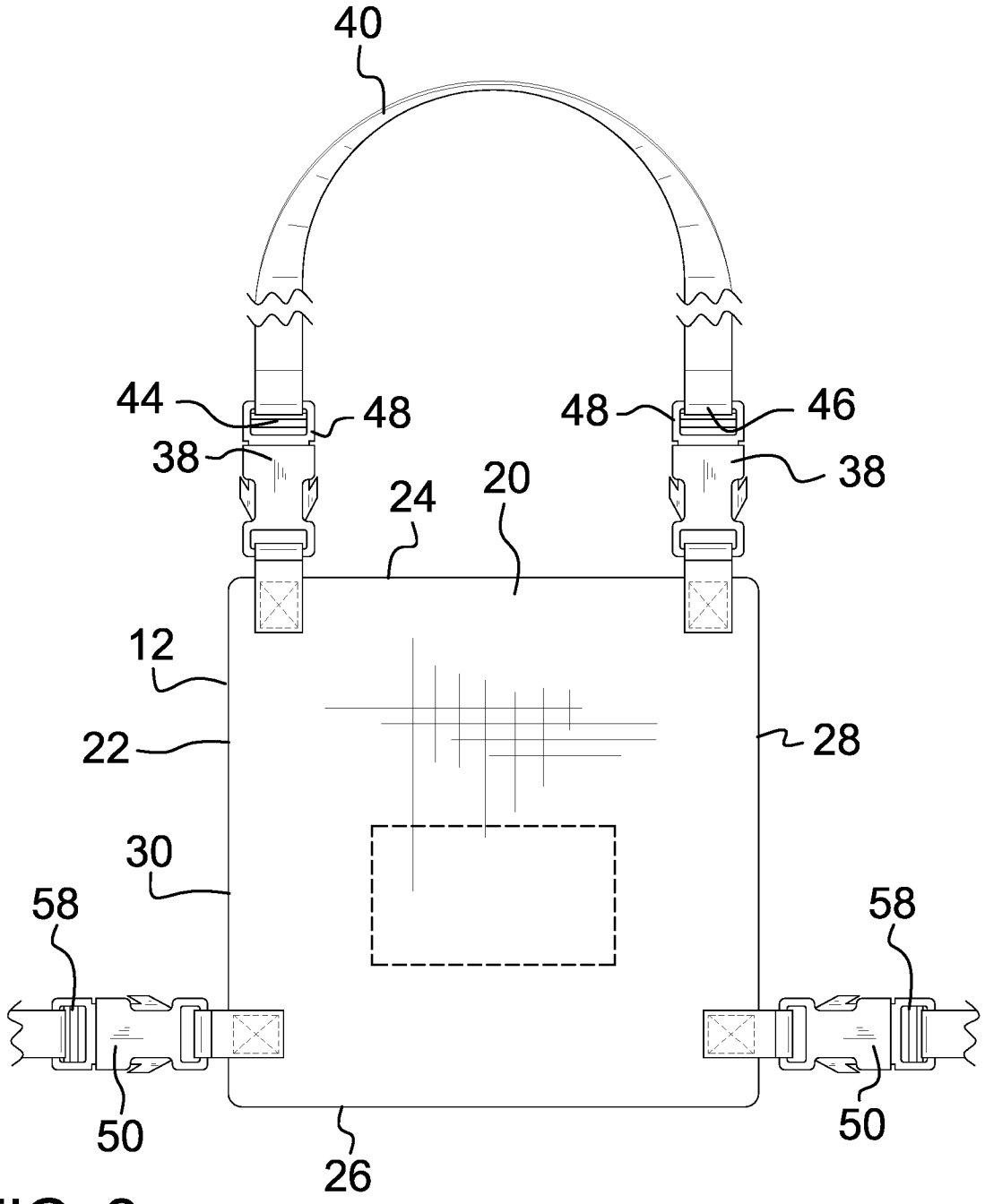
FIG. 2 is a back phantom view of an embodiment of the disclosure.
Figure 3:
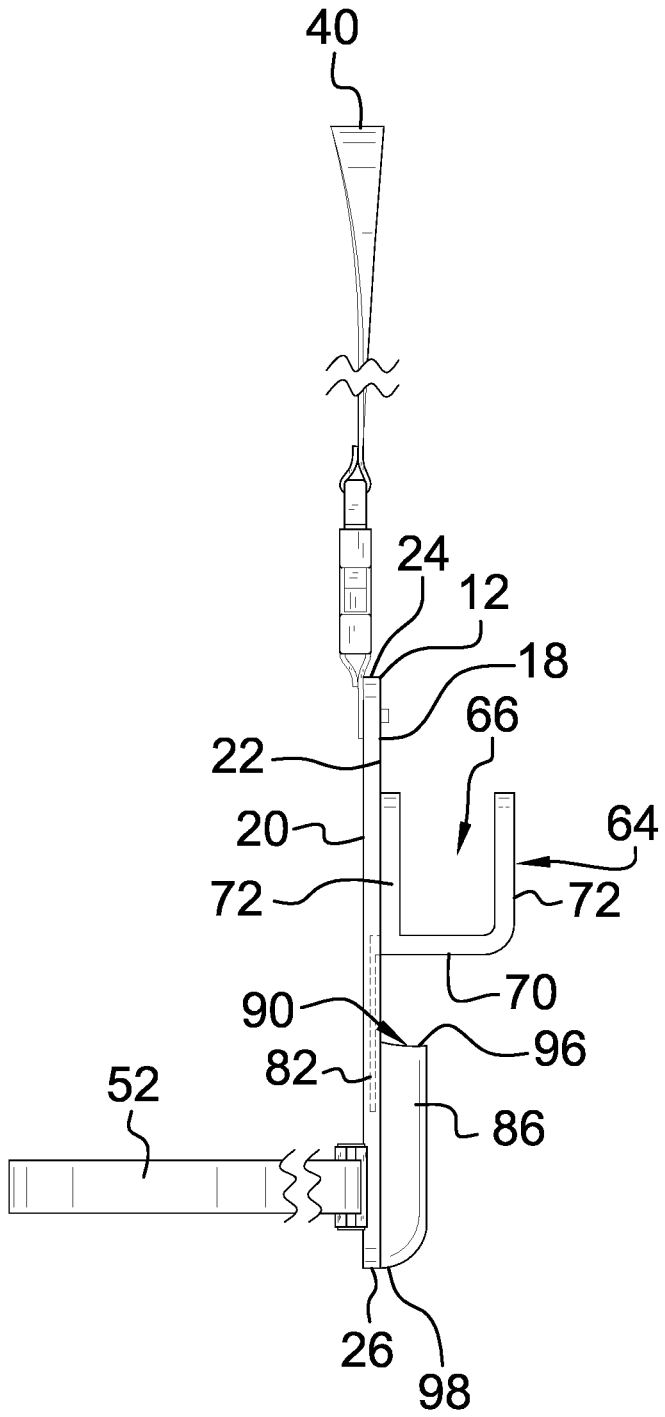
FIG. 3 is a right side view of an embodiment of the disclosure.
Figure 4:
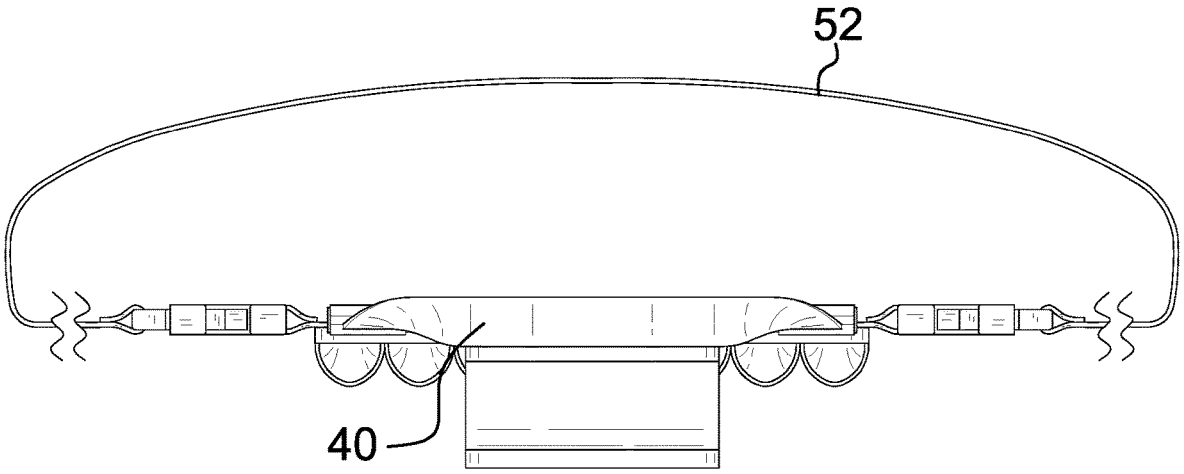
FIG. 4 is a top view of an embodiment of the disclosure.
Figure 5:
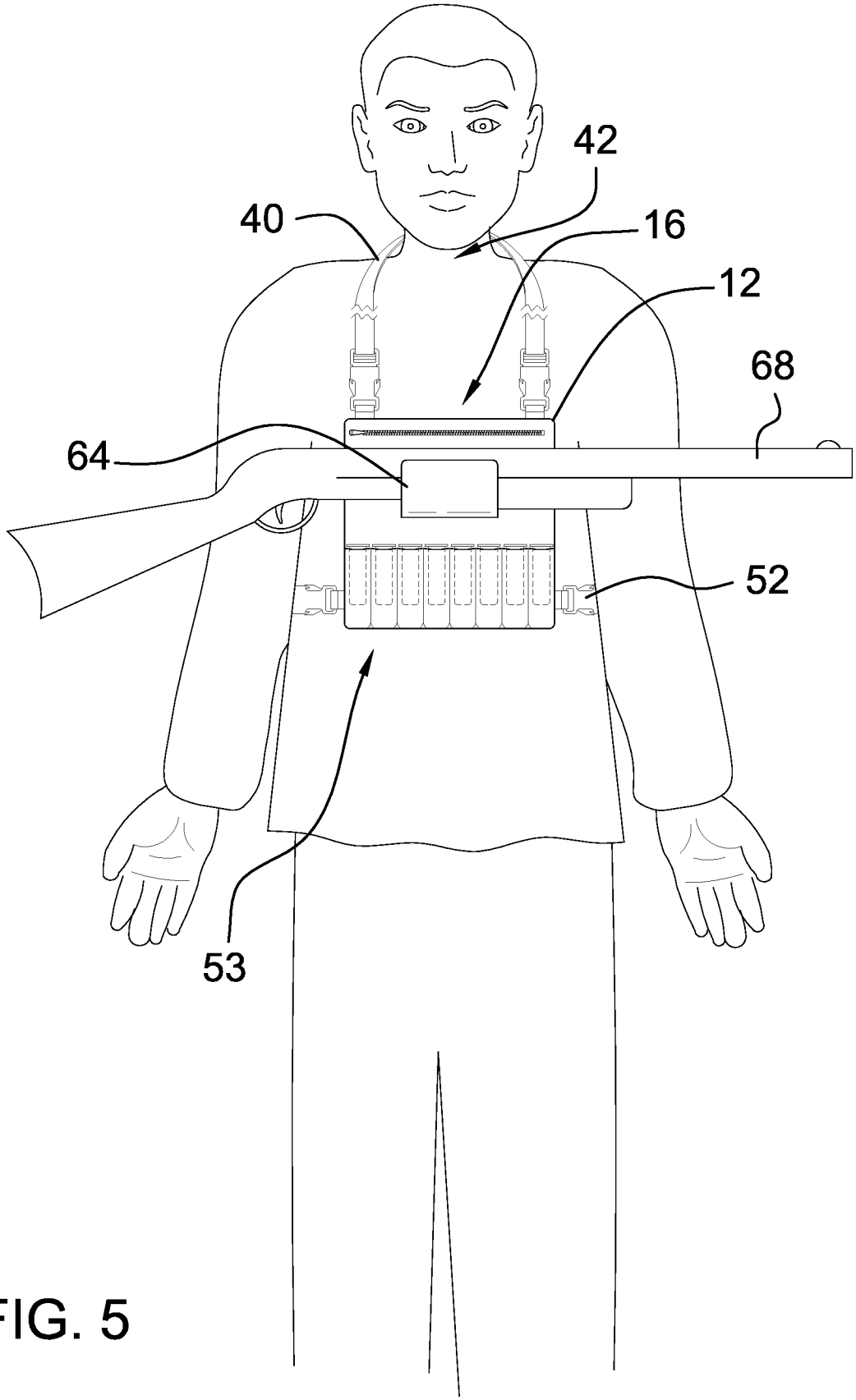
FIG. 5 is a front in-use view of an embodiment of the disclosure.
Figure 6:
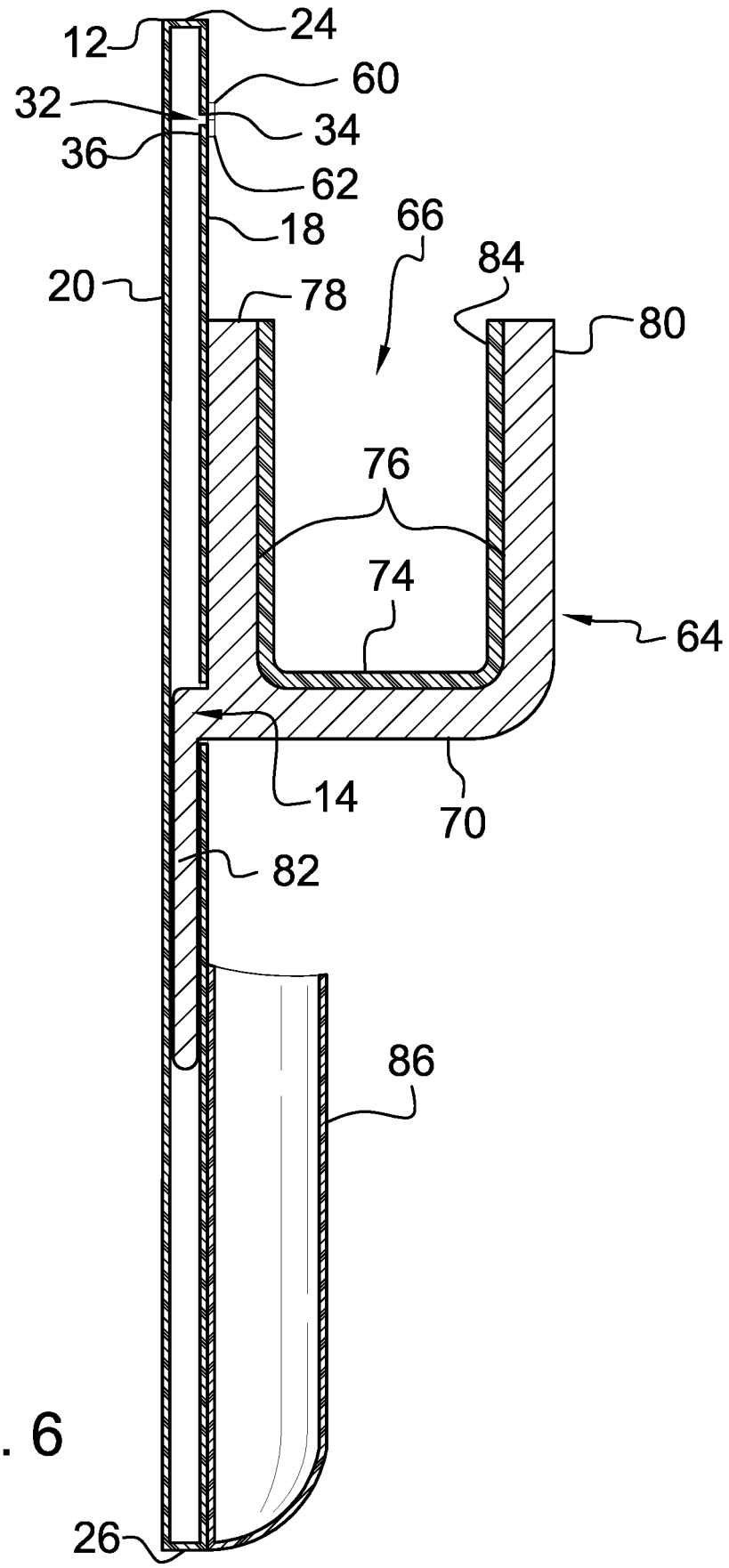
FIG. 6 is a cross sectional view taken along line 6-6 of FIG. 1 of an embodiment of the disclosure.

With reference now to the drawings, and in particular to FIGS. 1 through 8 thereof, a new gun rest device embodying the principles and concepts of an embodiment of the disclosure and generally designated by the reference numeral 10 will be described.

As best illustrated in FIGS. 1 through 8, the wearable gun rest assembly 10 generally comprises a panel 12 is hollow. The panel 12 has a slot 14 extending into an interior of the panel 12 and the panel 12 can be positioned on a user's chest 16. The panel 12 has a front wall 18, a back wall 20 and an outer wall 22 extending therebetween, and the outer wall 22 has a top side 24, a bottom side 26, a first lateral side 28 and a second lateral side 30. The slot 14 extends through the front wall 18 and the slot 14 is oriented to extend substantially between the first lateral side 28 and the second lateral side 30. The slot 14 is centrally positioned between the top side 24 and the bottom side 26, and the front wall 18 has a cut 32 extending into the interior of the panel 12. The cut 32 extends substantially between the first lateral side 28 and the second lateral side 30, and the cut 32 is positioned closer to the top side 24 than the slot 14. Moreover, the cut 32 has an upper bounding edge 34 and a lower bounding edge 36.

A pair of top mating units 38 is provided and each of the top mating units 38 is movably coupled to the panel 12. Each of the top mating units 38 is positioned on the top side 24 of the outer wall 22. Moreover, each of the top mating units 38 is positioned adjacent to a respective one of the first lateral side 28 and the second lateral side 30 of the outer wall 22. Each of the top mating units 38 may comprise a female buckle, a female clasp or any other type of releasable, mechanical fastener.

A neck strap 40 is provided and the neck strap 40 is releasably attachable to each of the top mating units 38 having the neck strap 40 forming a closed loop with the panel 12. In this way the neck strap 40 can extend around the user's neck 42 thereby facilitating the panel 12 to be supported on the user's chest 16. The neck strap 40 has a first end 44 and a second end 46, and a pair of neck mating units 48 is each coupled to a respective one of the first end 44 and the second end 46 of the neck strap 40. Each of the neck mating units 48 releasably engages a respective one of the top mating units 38 for attaching the neck strap 40 to the top mating units 38. Each of the neck mating units 48 may comprise a male buckle, a male clasp or any other type of releasable, mechanical fastener that is complementary to the top mating units 38.

A pair of side mating units 50 is provided and each of the side mating units 50 is movably coupled to the panel 12. Each of the side mating units 50 is positioned on a respective one of the first lateral side 28 and the second lateral side 30 of the outer wall 22. Each of the side mating units 50 may comprise a female buckle, a female clasp or any other type of releasable, mechanical fastener. A waist strap 52 is releasably attachable to each of the side mating units 50 having the waist strap 52 forming a closed loop with the panel 12. In this way the waist strap 52 can extend around the user's waist 53 thereby facilitating the panel 12 to be retained against the user's chest 16.

The waist strap 52 has a primary end 54 and a secondary end 56, and a pair of waist mating units 58 is each coupled to a respective one of the primary end 54 and the secondary end 56 of the waist strap 52. Each of the waist mating units 58 releasably engages a respective one of the side mating units 50 for attaching the waist strap 52 to the side mating units 50. Each of the waist mating units 58 may comprise a male buckle, a male clasp or any other type of releasable, mechanical fastener that is complementary to the side mating units.

A first mating member 60 is coupled to the upper bounding edge 34 of the cut 32 and the first mating member 60 extends along a full length of the upper bounding edge 34. A second mating member 62 is coupled to the lower bounding edge 36 of the cut 32 and the second mating member 62 extends along a full length of the lower bounding edge 36. The second mating member 62 is matable to the first mating member 60 for opening and closing the cut 32. Each of the first mating member 60 and the second mating member 62 may comprise complementary portions of a zipper or other similar type of mechanical fastener. Additionally, objects or tools used for hunting can be inserted through the cut 32 for storage within the panel 12.

A gun support 64 is removably integratable into the panel 12 such that the gun support 64 is positioned on the user's chest 16 when the panel 12 is worn on the user's chest 16. The gun support 64 has a gun slot 66 is integrated therein to insertably receive a firearm 68 for supporting the firearm 68 in a horizontal orientation. In this way the user does not have to carry the firearm 68 while the user is walking during pheasant hunting, duck hunting or other types of hunting that typically involve walking significant distances while carrying the firearm 68. The firearm 68 may be a shotgun, a rifle or other type of long gun.

The gun support 64 includes a lower portion 70 extending between a pair of upright portions 72. The upright portions 72 are spaced apart from each other and extend along an axis that is oriented perpendicular to the lower portion 70 to define the gun slot 66 extending between the upright portions 72. Thus, the lower portion 70 can have the firearm 68 rest thereon having each of the upright portions 72 retaining the firearm 68 in the gun slot 66. The lower portion 70 has a top surface 74, and each of the upright portions 72 has an inwardly facing surface 76 that is directed toward each other.

The pair of upright portions 72 includes a back upright portion 78 and a front upright portion 80. An intersection between the lower portion 70 and the back upright portion 78 forms a right angle. Moreover, an intersection between the lower portion 70 and the front upright portion 80 is arcuate. The gun support 64 has a foot 82 extending downwardly from the lower portion 70 such that the foot 82 extends in an opposite direction from the upright portions 72. Moreover, the foot 82 is offset from the back upright portion 78. The foot 82 is insertable into the slot 14 in the panel 12 having the back upright portion 78 resting against the front wall 18 of the panel 12. In this way the gun support 64 can support the weight of the firearm 68.

A cushion 84 is provided and the cushion 84 is coupled to the gun support 64. The cushion 84 is positioned in the gun slot 66 thereby facilitating the firearm 68 to lie on the cushion 84. The cushion 84 is comprised of a resiliently compressible material to inhibit the firearm 68 from being damaged by the gun support 64. The cushion 84 completely covers the inwardly facing surface 76 of each of the upright portions 72 and the cushion 84 completely covers the top surface 74 of the lower portion 70.

A band 86 is provided and the band 86 is coupled to the panel 12 at a plurality of attachment points 88 that are distributed along the band 86 to define a plurality of ammunition loops 90 in the band 86. In this way each of the ammunition loops 90 can insertably receive ammunition for the firearm 68. The band 86 has a first end 92, a second end 94, a top edge 96 and a bottom edge 98. Each of the first end 92, the second end 94 and the bottom edge 98 is coupled to the front wall 18 of the panel 12. Additionally, each of the attachment points 88 extends between the bottom edge 98 and the top edge 96. The attachment points 88 are spaced apart from each other and are distributed between the first end 92 and the second end 94 of the band 86. The band 86 is comprised of a resiliently stretchable material to accommodate a variety of sizes of ammunition.

Figure 7:
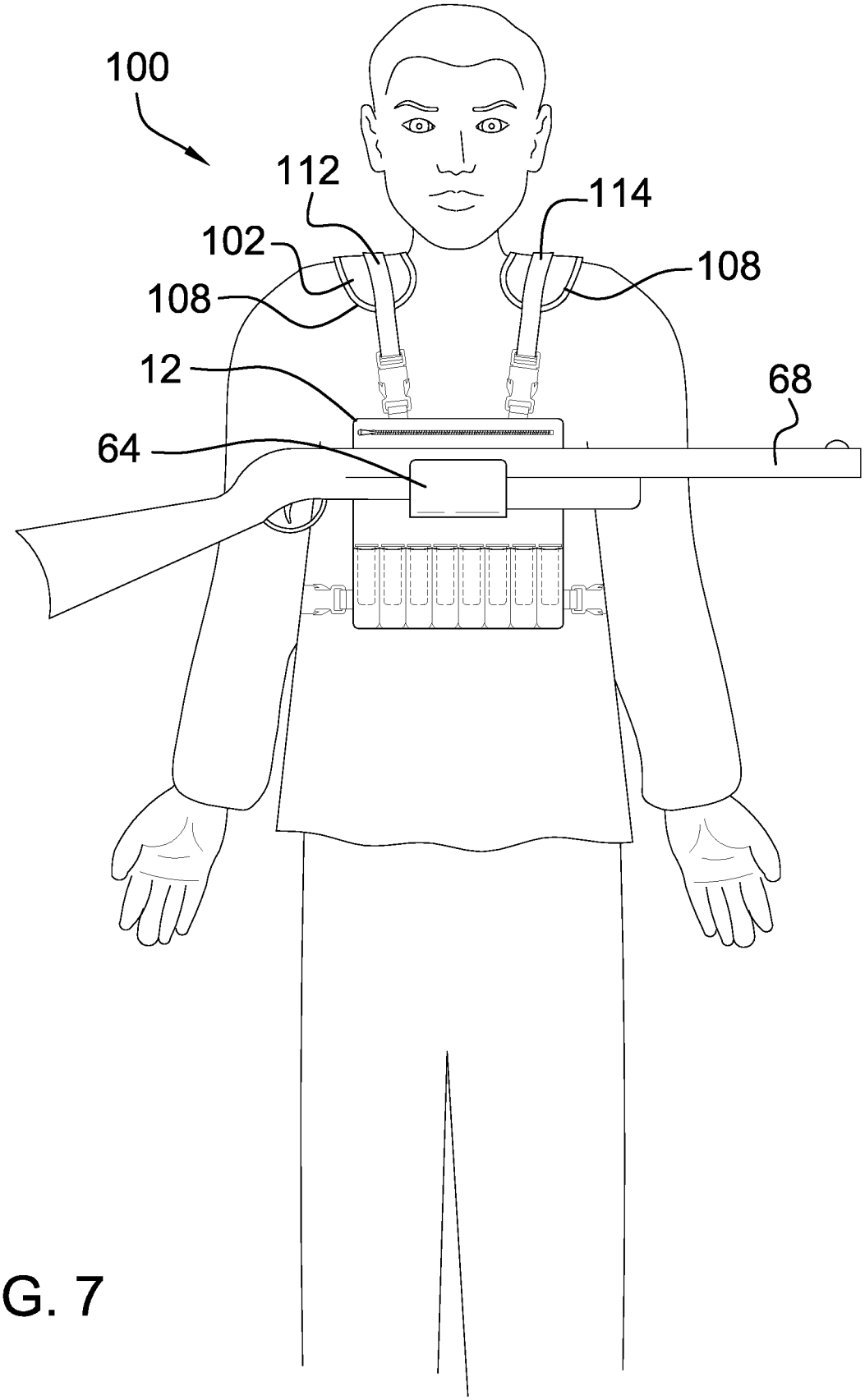
FIG. 7 is a front in-use view of an alternative embodiment of the disclosure.
Figure 8:
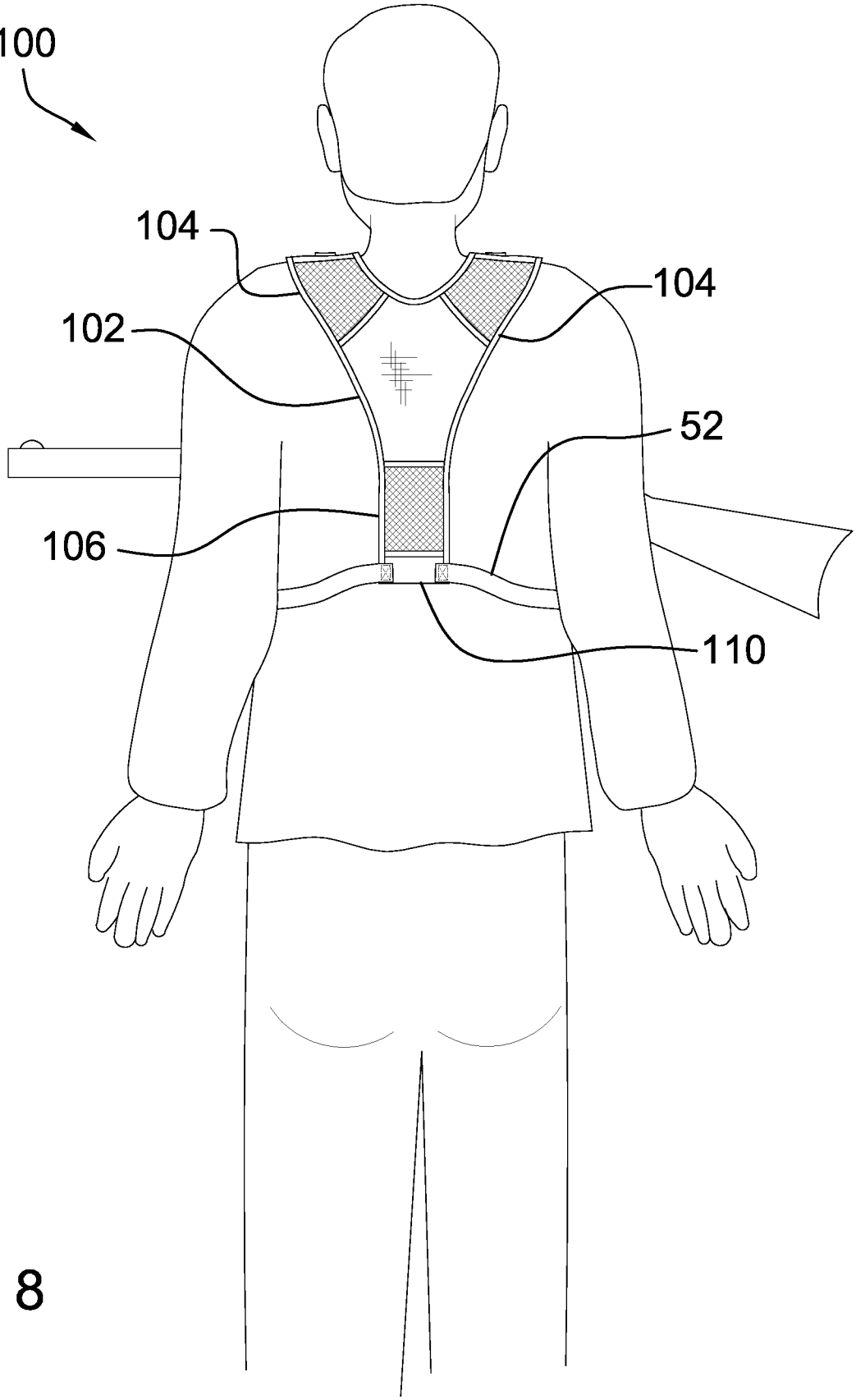
FIG. 8 is a back in-use view of an alternative embodiment of the disclosure.

In an alternative embodiment 100 as is most clearly shown in FIGS. 7 and 8, a pad 102 is provided that has a pair of first arms 104 each being oriented at an obtuse angle with a second arm 106. Additionally, each of the first arms 104 extends away from each other such that the pad 102 has a Y shape. Each of the first arms 104 has a distal end 108 with respect to the second arm 106, and the second arm 106 has a distal end 110 with respect to the first arms 104. The pad 102 is comprised of a resiliently compressible material.

Continuing in the alternative embodiment 100, the neck strap 40 is divided into a first portion 112 and a second portion 114. Each of the first portion 112 and the second portion 114 is coupled to the distal end 108 of a respective one of the first arms 104. In this way each of the first arms 104 can extend over a respective one of the user's shoulders 116. The distal end 110 of the second arm 106 is coupled to the waist strap 52 such that the second arm 106 can extend downwardly along the user's back 118.

In use, the neck strap 40 is worn around the user's neck 42 and the waist strap 52 is worn around the user's waist 53. In this way the panel 12 is positioned on the user's chest 16. The foot 82 of the gun support 64 is inserted into the slot 14 in the panel 12 thereby facilitating the gun support 64 to be positioned on the panel 12. In this way the firearm 68 can be positioned in the gun slot 66 while the user is walking. Thus, the user does not have to carry the full weight of the firearm 68 while the user is walking. Additionally, ammunition for the firearm 68 can be stored in the band 86.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wearable gun rest assembly for supporting a firearm on a user's chest while the user is hunting, said assembly comprising:

a panel being hollow, said panel having a slot extending into an interior of said panel, said panel being configured to be positioned on a user's chest;

a pair of top mating units, each of said top mating units being movably coupled to said panel;

a neck strap being releasably attachable to each of said top mating units having said neck strap forming a closed loop with said panel wherein said neck strap is configured to extend around the user's neck thereby facilitating said panel to be supported on the user's chest;

a pair of side mating units, each of said side mating units being movably coupled to said panel;

a waist strap being releasably attachable to each of said side mating units having said waist strap forming a closed loop with said panel wherein said waist strap is configured to extend around the user's waist thereby facilitating said panel to be retained against the user's chest;

a gun support being removably integratable into said panel wherein said gun support is configured to be positioned on the user's chest when said panel is worn on the user's chest, said gun support having a gun slot being integrated therein wherein said gun slot is configured to insertably receive a firearm to support the firearm in a horizontal orientation;

a cushion being coupled to said gun support, said cushion being positioned in said gun slot wherein said cushion is configured to have the firearm lie thereon, said cushion being comprised of a resiliently compressible material wherein said cushion is configured to inhibit the firearm from being damaged by said gun support;

a band being coupled to said panel at a plurality of attachment points being distributed along said band to define a plurality of ammunition loops in said band wherein each of said ammunition loops is configured to insertably receive ammunition for the firearm.

2. The assembly according to claim 1, wherein said panel has a front wall, a back wall and an outer wall extending therebetween, said outer wall having a top side, a bottom side, a first lateral side and a second lateral side, said slot extending through said front wall, said slot being oriented to extend substantially between said first lateral side and said second lateral side, said slot being centrally positioned between said top side and said bottom side.

3. The assembly according to claim 2, wherein said front wall has a cut extending into said interior of said panel, said cut extending substantially between said first lateral side and said second lateral side, said cut being positioned closer to said top side than said slot, said cut having an upper bounding edge and a lower bounding edge.

4. The assembly according to claim 3, further comprising a first mating member being coupled to said upper bounding edge of said cut, said first mating member extending along a full length of said upper bounding edge.

5. The assembly according to claim 4, further comprising a second mating member being coupled to said lower bounding edge of said cut, said second mating member extending along a full length of said lower bounding edge, said second mating member being matable to said first mating member for opening and closing said cut.

6. The assembly according to claim 2, wherein:

each of said top mating units is positioned on said top side of said outer wall, each of said top mating units being positioned adjacent to a respective one of said first lateral side and said second lateral side of said outer wall;

said neck strap has a first end and a second end; and said assembly includes a pair of neck mating units, each of said neck mating units being coupled to a respective one of said first end and said second end of said neck strap, each of said neck mating units releasably engaging a respective one of said top mating units for attaching said neck strap to said top mating units.

7. The assembly according to claim 2, further comprising:

each of said side mating units is positioned on a respective one of said first lateral side and said second lateral side of said outer wall;

said waist strap has a primary end and a secondary end;

said assembly includes a pair of waist mating units, each of said waist mating units being coupled to a respective one of said primary end and said secondary end of said waist strap, each of said waist mating units releasably engaging a respective one of said side mating units for attaching said waist strap to said side mating units.

8. The assembly according to claim 2, wherein said band has a first end, a second end, a top edge and a bottom edge, each of said first end, said second end and said bottom edge being coupled to said front wall of said panel, each of said attachment points extending between said bottom edge and said top edge, said attachment points being spaced apart from each other and being distributed between said first end and said second end of said band, said band being comprised of a resiliently stretchable material wherein said band is configured to accommodate a variety of sizes of ammunition.

9. The assembly according to claim 1, wherein said gun support includes a lower portion extending between a pair of upright portions, said upright portions being spaced apart from each other and extending along an axis being oriented perpendicular to said lower portion to define said gun slot extending between said upright portions wherein said lower portion is configured to have the firearm rest thereon having each of said upright portions retaining the firearm in said gun slot, said lower portion having a top surface, each of said upright portions having an inwardly facing surface being directed toward each other.

10. The assembly according to claim 9, wherein said pair of upright portions includes a back upright portion and a front upright portion, an intersection between said lower portion and said back upright portion forming a right angle, an intersection between said lower portion and said front upright portion being arcuate.

11. The assembly according to claim 10, wherein said gun support has a foot extending downwardly from said lower portion such that said foot extends in an opposite direction from said upright portions, said foot being offset from said back upright portion, said foot being insertable into said slot in said panel having said back upright portion resting against a front wall of said panel wherein said gun support is configured to support the weight of the firearm.

12. The assembly according to claim 9, wherein said cushion completely covers said inwardly facing surface of each of said upright portions, said cushion completely covering said top surface of said lower portion.

13. A wearable gun rest assembly for supporting a firearm on a user's chest while the user is hunting, said assembly comprising:

a panel being hollow, said panel having a slot extending into an interior of said panel, said panel being configured to be positioned on a user's chest, said panel having a front wall, a back wall and an outer wall extending therebetween, said outer wall having a top side, a bottom side, a first lateral side and a second lateral side, said slot extending through said front wall, said slot being oriented to extend substantially between said first lateral side and said second lateral side, said slot being centrally positioned between said top side and said bottom side, said front wall having a cut extending into said interior of said panel, said cut extending substantially between said first lateral side and said second lateral side, said cut being positioned closer to said top side than said slot, said cut having an upper bounding edge and a lower bounding edge;

a pair of top mating units, each of said top mating units being movably coupled to said panel, each of said top mating units being positioned on said top side of said outer wall, each of said top mating units being positioned adjacent to a respective one of said first lateral side and said second lateral side of said outer wall;

a neck strap being releasably attachable to each of said top mating units having said neck strap forming a closed loop with said panel wherein said neck strap is configured to extend around the user's neck thereby facilitating said panel to be supported on the user's chest, said neck strap having a first end and a second end;

a pair of neck mating units, each of said neck mating units being coupled to a respective one of said first end and said second end of said neck strap, each of said neck mating units releasably engaging a respective one of said top mating units for attaching said neck strap to said top mating units;

a pair of side mating units, each of said side mating units being movably coupled to said panel, each of said side mating units being positioned on a respective one of said first lateral side and said second lateral side of said outer wall;

a waist strap being releasably attachable to each of said side mating units having said waist strap forming a closed loop with said panel wherein said waist strap is configured to extend around the user's waist thereby facilitating said panel to be retained against the user's chest, said waist strap having a primary end and a secondary end;

a pair of waist mating units, each of said waist mating units being coupled to a respective one of said primary end and said secondary end of said waist strap, each of said waist mating units releasably engaging a respective one of said side mating units for attaching said waist strap to said side mating units;

a first mating member being coupled to said upper bounding edge of said cut, said first mating member extending along a full length of said upper bounding edge;

a second mating member being coupled to said lower bounding edge of said cut, said second mating member extending along a full length of said lower bounding edge, said second mating member being matable to said first mating member for opening and closing said cut;

a gun support being removably integratable into said panel wherein said gun support is configured to be positioned on the user's chest when said panel is worn on the user's chest, said gun support having a gun slot being integrated therein wherein said gun slot is configured to insertably receive a firearm to support the firearm in a horizontal orientation, said gun support including a lower portion extending between a pair of upright portions, said upright portions being spaced apart from each other and extending along an axis being oriented perpendicular to said lower portion to define said gun slot extending between said upright portions wherein said lower portion is configured to have the firearm rest thereon having each of said upright portions retaining the firearm in said gun slot, said lower portion having a top surface, each of said upright portions having an inwardly facing surface being directed toward each other, said pair of upright portions including a back upright portion and a front upright portion, an intersection between said lower portion and said back upright portion forming a right angle, an intersection between said lower portion and said front upright portion being arcuate, said gun support having a foot extending downwardly from said lower portion such that said foot extends in an opposite direction from said upright portions, said foot being offset from said back upright portion, said foot being insertable into said slot in said panel having said back upright portion resting against said front wall of said panel wherein said gun support is configured to support the weight of the firearm;

a cushion being coupled to said gun support, said cushion being positioned in said gun slot wherein said cushion is configured to have the firearm lie thereon, said cushion being comprised of a resiliently compressible material wherein said cushion is configured to inhibit the firearm from being damaged by said gun support, said cushion completely covering said inwardly facing surface of each of said upright portions, said cushion completely covering said top surface of said lower portion; and a band being coupled to said panel at a plurality of attachment points being distributed along said band to define a plurality of ammunition loops in said band wherein each of said ammunition loops is configured to insertably receive ammunition for the firearm, said band having a first end, a second end, a top edge and a bottom edge, each of said first end, said second end and said bottom edge being coupled to said front wall of said panel, each of said attachment points extending between said bottom edge and said top edge, said attachment points being spaced apart from each other and being distributed between said first end and said second end of said band, said band being comprised of a resiliently stretchable material wherein said band is configured to accommodate a variety of sizes of ammunition.

14. The assembly according to claim 13, further comprising a pad having a pair of first arms each being oriented at an obtuse angle with a second arm having each of said first arms extending away from each other such that said pad has a Y shape, each of said first arms having a distal end with respect to said second arm, said second arm having a distal end with respect to said first arms.

15. The assembly according to claim 14, wherein said neck strap is divided into a first portion and a second portion, each of said first portion and said second portion being coupled to said distal end of a respective one of said first arms wherein each of said first arms is configured to extend over a respective one of the user's shoulders.

16. The assembly according to claim 14, further comprising said distal end of said second arm is coupled to said waist strap wherein said second arm is configured to extend downwardly along the user's back.

* * * * *